US009113737B2

(12) United States Patent
Goldstein et al.

(10) Patent No.: US 9,113,737 B2
(45) Date of Patent: Aug. 25, 2015

(54) METHOD AND APPARATUS FOR CLOTHES HANGER DEVICE

(71) Applicants: Darcy Pulitzer Goldstein, New Orleans, LA (US); Lisa Pulitzer Zoller, New Orleans, LA (US)

(72) Inventors: Darcy Pulitzer Goldstein, New Orleans, LA (US); Lisa Pulitzer Zoller, New Orleans, LA (US)

( * ) Notice: Subject to any disclaimer, the term of this patent is extended or adjusted under 35 U.S.C. 154(b) by 196 days.

(21) Appl. No.: 13/865,421

(22) Filed: Apr. 18, 2013

(65) Prior Publication Data

US 2014/0312080 A1 Oct. 23, 2014

(51) Int. Cl.
*A41D 27/22* (2006.01)
*A47G 25/74* (2006.01)

(52) U.S. Cl.
CPC ..... *A47G 25/743* (2013.01); *Y10T 29/49826* (2015.01)

(58) Field of Classification Search
CPC ..... A47G 25/28; A47G 25/30; A47G 25/145; A47G 25/1457; A47G 25/1464; A47G 25/743; A47G 25/746; A47G 25/4053; A47G 25/4015; A47G 25/4023
USPC ..... 223/85, 88, 89, DIG. 1
See application file for complete search history.

(56) References Cited

U.S. PATENT DOCUMENTS

| | | | | | |
|---|---|---|---|---|---|
| 1,514,987 | A * | 11/1924 | Normandy | 223/88 |
| 1,895,695 | A * | 1/1933 | White | 223/88 |
| 2,149,674 | A * | 3/1939 | Hendrix | 223/95 |
| 2,510,452 | A * | 6/1950 | Witt | 211/85.3 |
| 2,929,509 | A * | 3/1960 | Van Dusen | 211/59.1 |
| 3,042,275 | A * | 7/1962 | Wendorf | 223/88 |
| 3,194,457 | A * | 7/1965 | Freilich | 223/88 |
| 3,409,191 | A * | 11/1968 | Fuss | 223/91 |
| 4,474,316 | A * | 10/1984 | Philibert | 223/88 |
| 4,556,158 | A * | 12/1985 | Blanchard et al. | 223/88 |
| 5,161,720 | A * | 11/1992 | Kolton et al. | 223/85 |
| 5,642,817 | A * | 7/1997 | O'Brien | 211/60.1 |
| 6,334,559 | B1 * | 1/2002 | Armaly | 223/85 |
| 6,478,168 | B1 * | 11/2002 | McNamee | 211/85.3 |
| 7,290,686 | B2 * | 11/2007 | von Detten | 223/88 |
| 8,444,029 | B2 * | 5/2013 | Ferraro et al. | 223/91 |
| 2004/0020948 | A1 * | 2/2004 | Harris | 223/85 |

FOREIGN PATENT DOCUMENTS

| | | | | |
|---|---|---|---|---|
| GB | 2055571 | A * | 3/1981 | A47J 51/08 |

* cited by examiner

*Primary Examiner* — Nathan Durham
(74) *Attorney, Agent, or Firm* — Walter J. Tencza, Jr.

(57) ABSTRACT

An apparatus including a hook portion, a first device, a second device, including a first section, and a third device. The second device may be biased in a closed state wherein the first section of the second device, the first device, and the third device are aligned with each other. The first section of the second device, the first device, and the third device may be aligned in the closed state such that a closed loop of an item can be slid along the first section of the second device, the first device, and the third device. While in the closed state, the closed loop cannot be removed from the apparatus without breaking the apparatus. The second device can be placed in an open state by applying a force, which does not break the apparatus; and in the open state, the closed loop can be removed from the first section.

16 Claims, 17 Drawing Sheets

METHOD AND APPARATUS FOR CLOTHES HANGER DEVICE

FIELD OF THE INVENTION

This invention relates to improved methods and apparatus concerning clothes hangers.

BACKGROUND OF THE INVENTION

There are various devices known in the prior art for clothes hangers.

SUMMARY OF THE INVENTION

In at least one embodiment, an apparatus is provided comprising: a hook portion, a first device, a second device, including a first section, and a third device. The second device may be biased in a closed state so that the first section of the second device, the first device, and the third device are aligned with each other in the closed state. The hook portion may be connected to the first device and the third device. The first section of the second device, the first device, and the third device may be aligned in the closed state such that a closed loop of an item can be slid along the first section of the second device, the first device, and the third device with each of the first section of the second device, the first device, and the third device passing through an opening surrounded by the closed loop. While in the closed state, in at least one embodiment, the closed loop cannot be removed from the apparatus without breaking the apparatus. In at least one embodiment, the second device can be placed in an open state by applying a force, which does not break the apparatus; and in the open state, the closed loop can be removed from the first section.

The apparatus may be further comprised of a spring device, wherein the second device is biased in the closed state by the spring device which includes a spring. The spring may include a plate. The spring may include a coiled spring. The first section of the second device may be pivotally connected to the third device. In the closed state, the first device, the first section of the second device, and the third device may be in a substantially straight line, and may be in an order of the first device, then the first section of the second device, and then the third device.

In at least one embodiment, the hook portion has a first free end, and a second end which is connected to a first end of a first member, and a first end of a second member. A second end of the first member may be connected to the first device. A second end of the second member may be connected to the third device;

In at least one embodiment, a method is provided which may include applying a force which does not break an apparatus to place the apparatus in an open state; inserting one or more of a first device, a second device, and a third device of the apparatus through an opening surrounded by a closed loop of an item; and removing the force to place the apparatus in a closed state so that the closed loop of the item cannot be removed from the apparatus without either breaking the apparatus or placing the apparatus in an open state. The apparatus may be as previously described.

DETAILED DESCRIPTION OF THE DRAWINGS

Figure 1A:
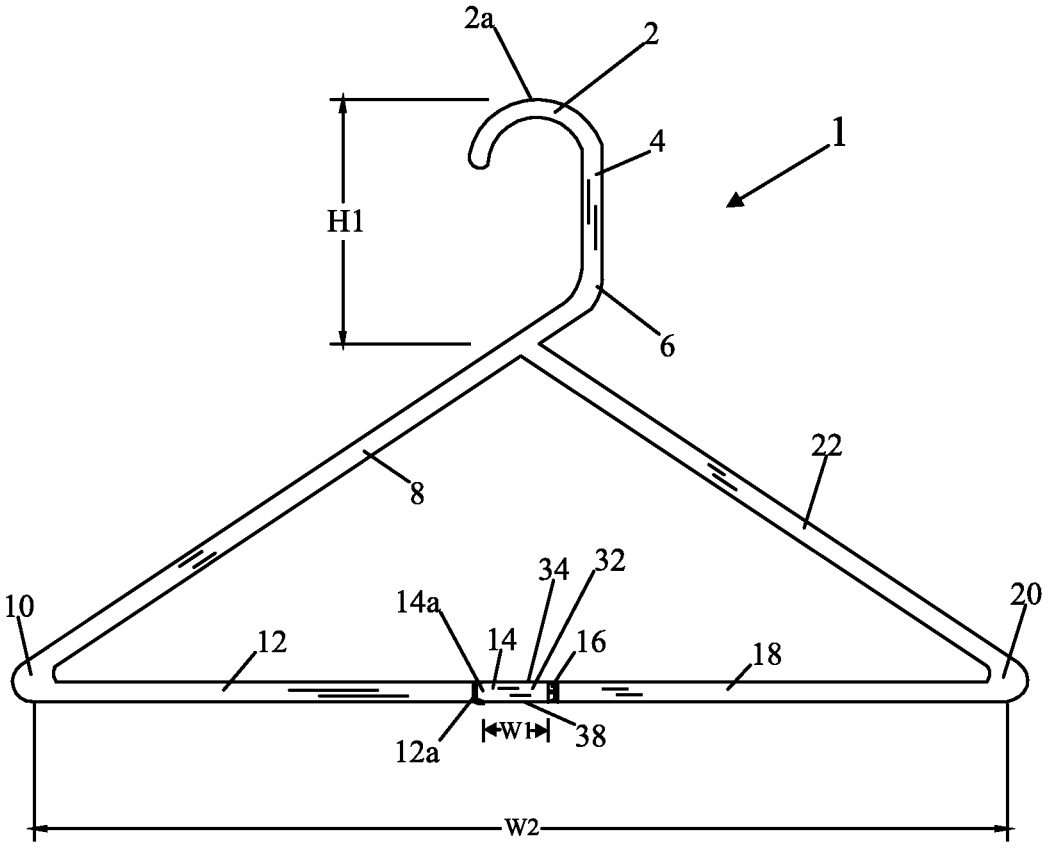
FIG. 1A shows a front view of a first clothes hanger device in accordance with an embodiment of the present invention, with the first clothes hanger device shown in a first state.
Figure 1B:
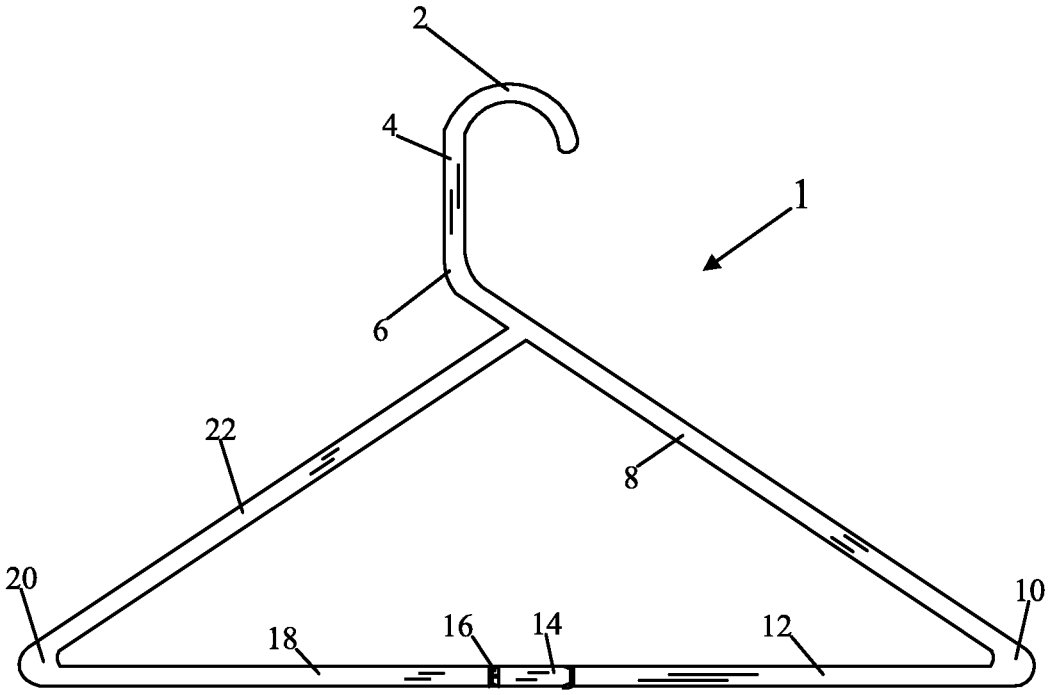
FIG. 1B shows a rear view of the first clothes hanger device, with the first clothes hanger device shown in the first state.

FIG. 1A shows a front view of a first clothes hanger device 1 in accordance with an embodiment of the present invention, with the first clothes hanger device 1 shown in a first state. FIG. 1B shows a rear view of the first clothes hanger device 1, with the first clothes hanger device 1 shown in the first state. The first clothes hanger device 1 may include a hook portion 2, a straight portion 4, a curved portion 6, a straight portion 8, a curved portion 10, a straight portion 12, a pivot portion 14 connected by a pivot pin 16 to a straight portion 18, a curved portion 20, and a straight portion 22. In the first state shown in FIGS. 1A-1B, the pivot portion 14 is aligned with the straight portions 12 and 18 and an end 14*a* of the pivot portion 14 is connected to an end 12*a* of the straight portion 12, such as by snap fit connection, and any other way of connecting which allows ends 12*a* and 14*a* to be attached and then detached from each other.

The straight portions 12, 14, and 18 have a combined width of W2, which may be about one foot and three inches, for example, or various other sizes. A height H1 shown in FIG. 1A, from about a top 2*a* of the hook 2, to a junction where portions 6, 8, and 22 meet, may be about three and three quarters inches, for example, or various other sizes. The pivot portion 14 may have a width W1, which may be about one inch, for example, or various other sizes.

Figure 2:
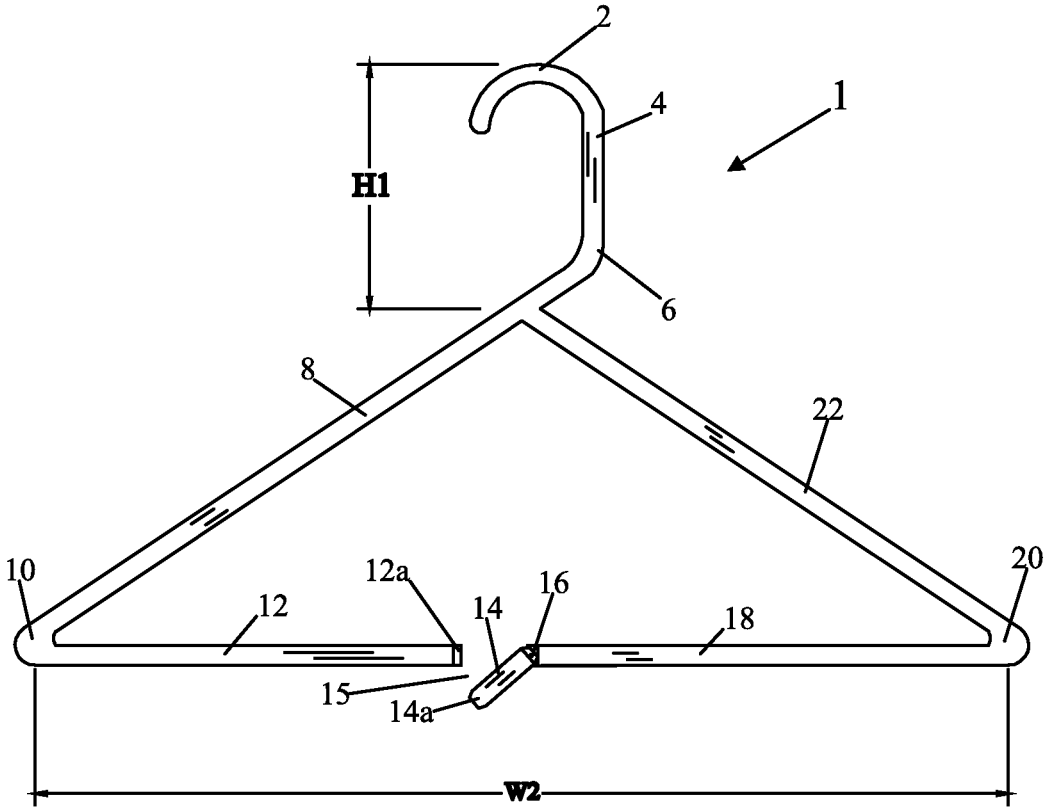
FIG. 2 shows a front view of the first clothes hanger device of FIGS. 1A-B, with the first clothes hanger device shown in a second state.

The first hanger device 1 may be of various thicknesses, tubular or square shaped and of various sizes. Left, right, top and bottom views have been omitted as unnecessary and readily apparent to those skilled in the art. FIG. 2 shows a front view of the first clothes hanger device 1, with the first clothes hanger device 1 shown in a second state. In the second state, the end 14*a* of the pivot portion 14 has been detached from the end 12*a* of the straight portion 12, and the pivot portion 14 has been pivoted about pin 16. This creates a gap 15 through which an item can be inserted or removed from the straight portions 12 and 18.

Figure 3A:
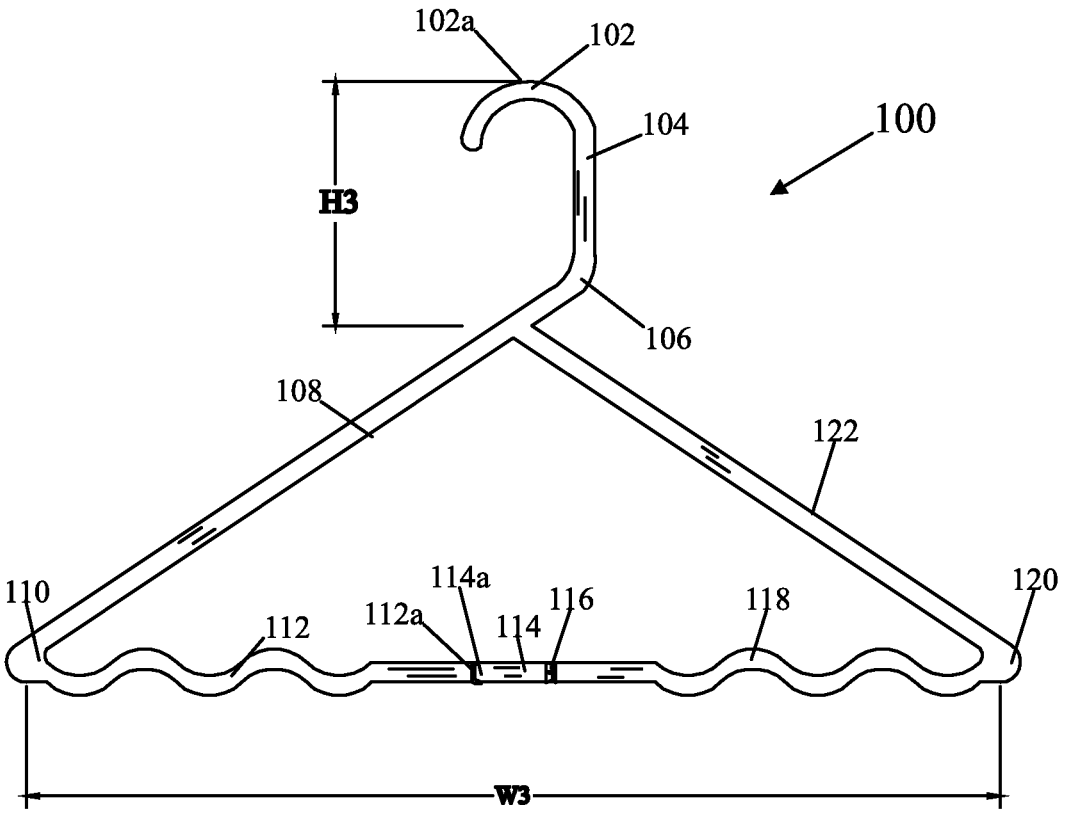
FIG. 3A shows a front view of a second clothes hanger device in accordance with another embodiment of the present invention, with the second clothes hanger device shown in a third state.
Figure 3B:
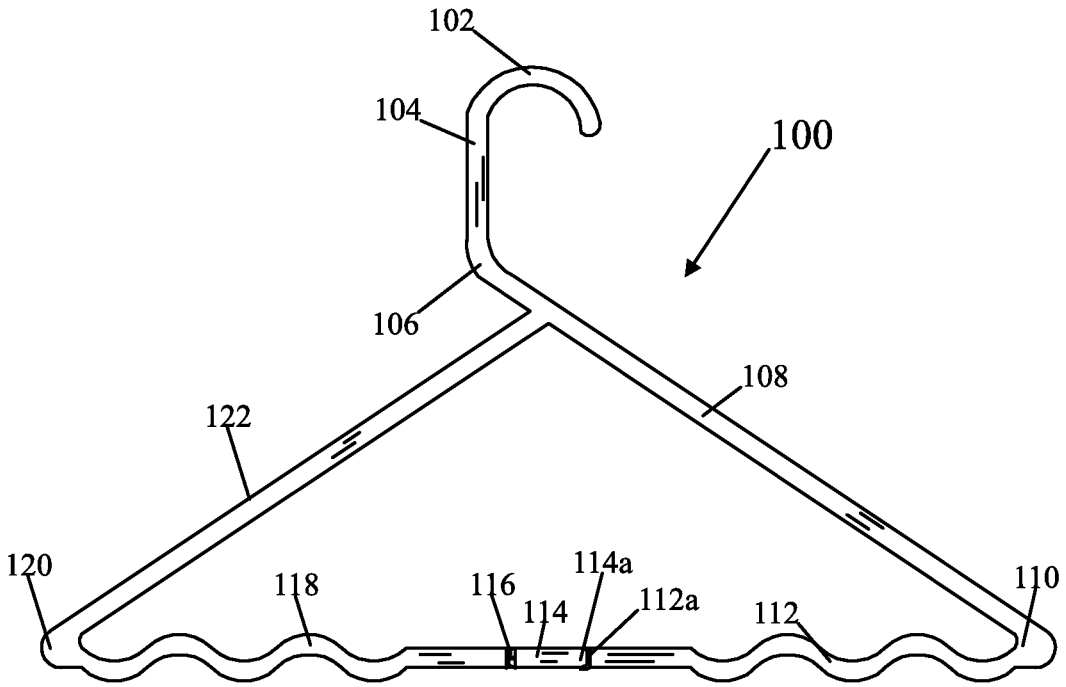
FIG. 3B shows a rear view of the second clothes hanger device in accordance with another embodiment of the present invention, with the second clothes hanger device shown in the third state.

FIG. 3A shows a front view of a second clothes hanger device 100 in accordance with another embodiment of the present invention, with the second clothes hanger device 100 shown in a third state. FIG. 3B shows a rear view of the second clothes hanger device 100, with the second clothes hanger device 100 shown in the third state.

The second clothes hanger device 100 may include a hook portion 102, a straight portion 104, a curved portion 106, a straight portion 108, a curved portion 110, a waved portion 112, a pivot portion 114 connected by a pivot pin 116 to a waved portion 118, a curved portion 120, and a straight portion 122. In the third state shown in FIGS. 3A-3B, an end 114*a* of the pivot portion 114 is connected to an end 112*a* of the waved portion 112, such as by snap fit connection, and any other way of connecting which allows ends 112*a* and 114*a* to be attached and then detached from each other.

The waved portion 112, pivot portion 114, and waved portion 118 have a combined width of W3, which may be about one foot and three inches, for example, or various other sizes. A height H3 shown in FIG. 3A, from about a top 102*a* of the hook 102, to a junction where portions 106, 108, and 122 meet, may be about three and three quarters inches, for example, or various other sizes.

The second hanger device 100 may be of various thicknesses, tubular or square shaped, and of various sizes. Left, right, top and bottom views have been omitted as unnecessary and readily apparent to those skilled in the art.

Figure 4A:
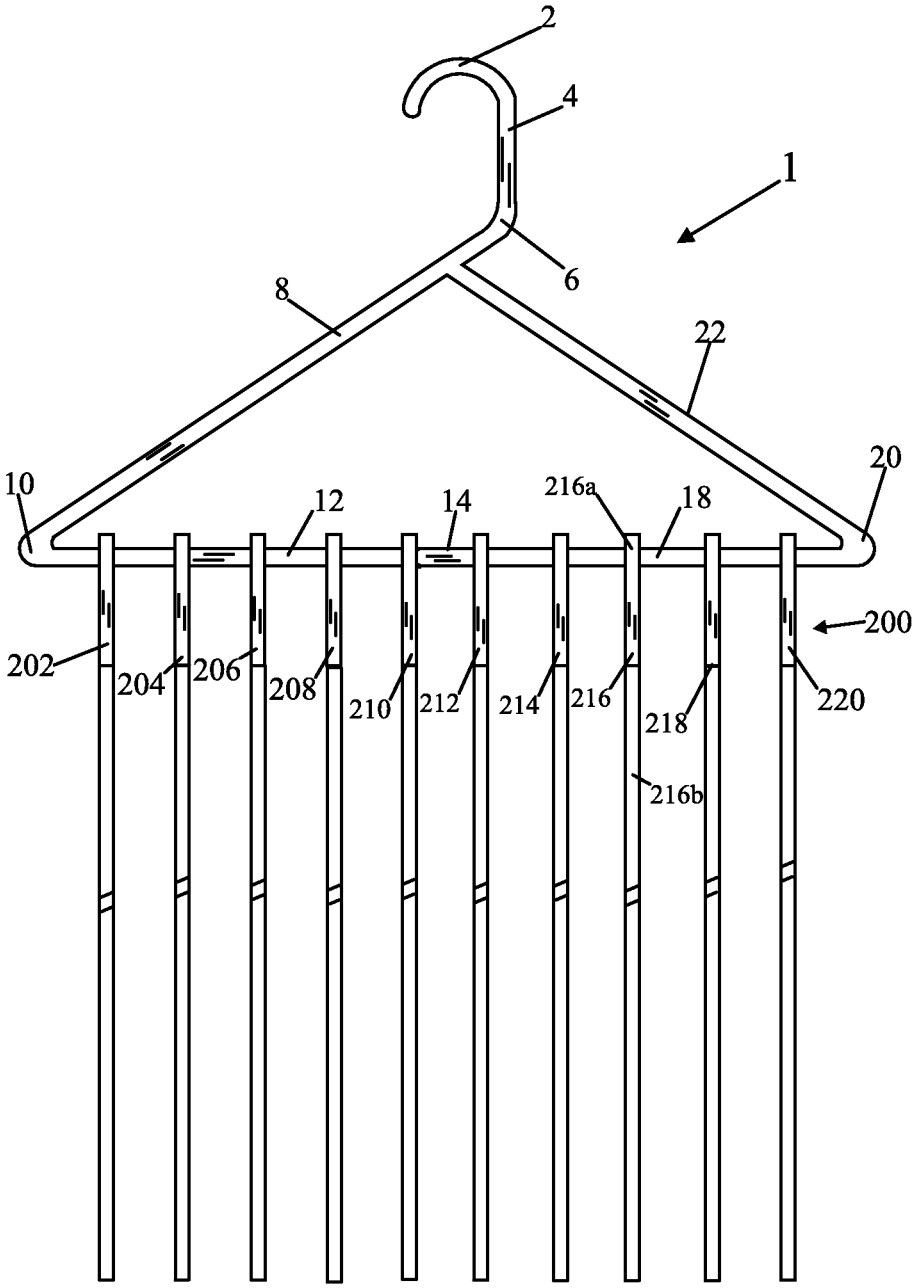
FIG. 4A shows a front view of the first clothes hanger device of FIGS. 1A-B in the first state, with a plurality of items hung from the first clothes hanger device.

FIG. 4A shows a front view of the first clothes hanger device 1 of FIG. 1 in the first state, with a plurality of items 200 hung from the first clothes hanger device 1. The plurality of items 200 may include items 202, 204, 206, 208, 210, 212, 214, 216, 218, and 220. In accordance with at least one embodiment of the present invention any item hung from the first clothes hanger device 1 would typically have a closed loop. The closed loop retains the item on the hanger device 1 or 100 and allows removal, at least in one embodiment, only when the pivot portion or section 14 (or 114 or 314) is opened, to allow the item to slide off of the hanger device 1 or 100.

Figure 4B:
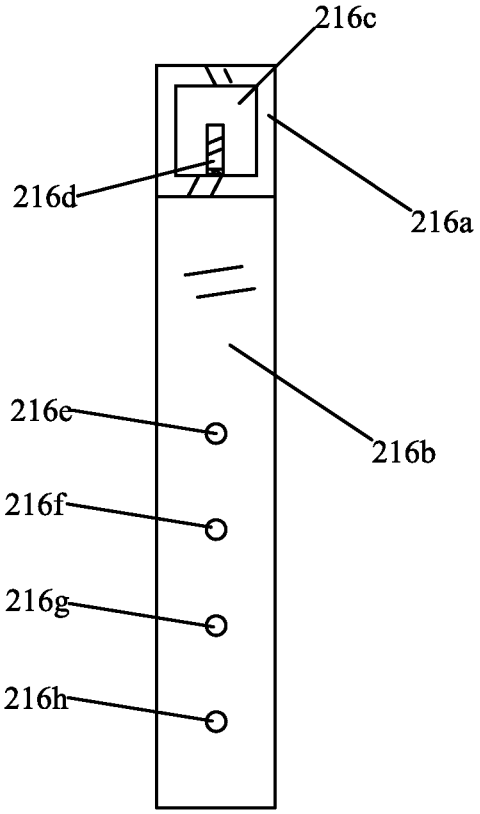
FIG. 4B shows a side view of one of the plurality of items of FIG. 4A.
Figure 5:
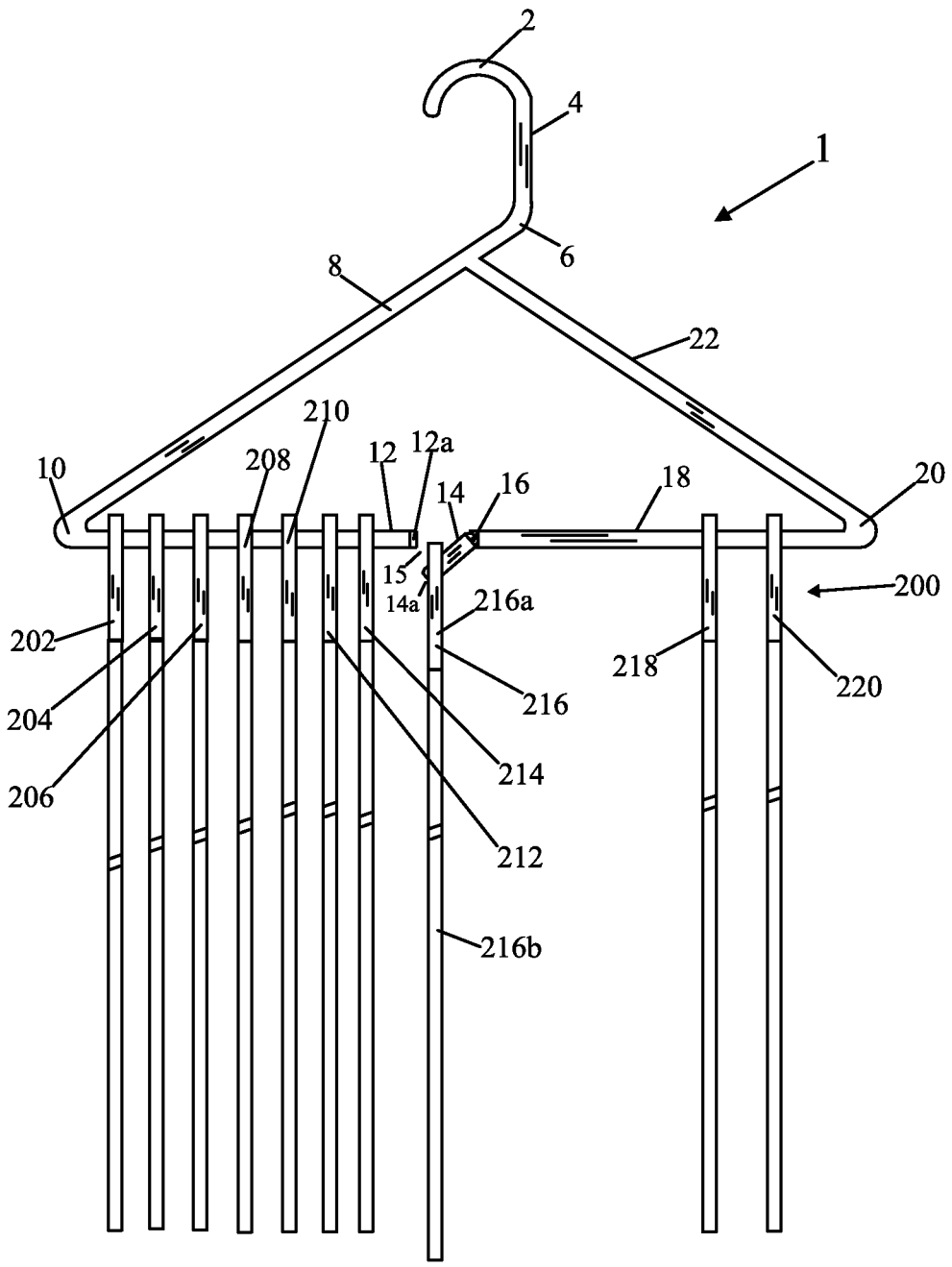
FIG. 5 shows a front view of the first clothes hanger device of FIGS. 1A-B in the second state, with the plurality of items hung from the first clothes hanger device, such that one of the plurality of items is in the process of being taken off of the first clothes hanger device.

FIG. 4B shows a side view of the item 216 of FIG. 4A. The item 216 includes a closed loop 216*a* having an opening 216*c* through which the sections or portion 12, 14, and 18 of FIG. 4A can be inserted to attach the item 216 onto the hanger device 1, when the portion 14 has been placed in an open state as shown in FIG. 5. The item 216 may be a belt having the closed loop or belt buckle 216*a*, a protrusion 216*d*, a belt or band portion 216*b*, and openings 216*e*, 216*f*, 216*g*, and 216*h*. One or more of the other items 202, 204, 206, 208, 210, 212, 214, 218, and 220 may also be belts having closed loops similar to or identical to closed loop 216*a*. Alternatively or additionally, one or more of the other items 202, 204, 206, 208, 210, 212, 214, 218, and 220 may be other items having closed loops similar or identical to closed loop 216*a*, such as bras, underwear or other items of clothing having closed loops.

FIG. 5 shows a front view of the first clothes hanger device 1 of FIG. 1 in the second state, with the plurality of items 200 hung from the first clothes hanger device 1, such that the item 216 is in the process of being taken off of the first clothes hanger device 1. The end 14*a* of the pivot portion 14 has been detached from the end 12*a* of the portion 12 and the pivot portion 12 has been pivoted to cause an opening or gap 15. The item 216 is shown in FIG. 5, slid a distance down on the pivot portion 14, into or near the gap 15. The item 216 can be completely removed from and detached from the hanger device 1, and any other of the other items 202, 204, 206, 208, 210, 212, 214, 218, and 220 can be removed from the hanger device 1.

Figure 6:
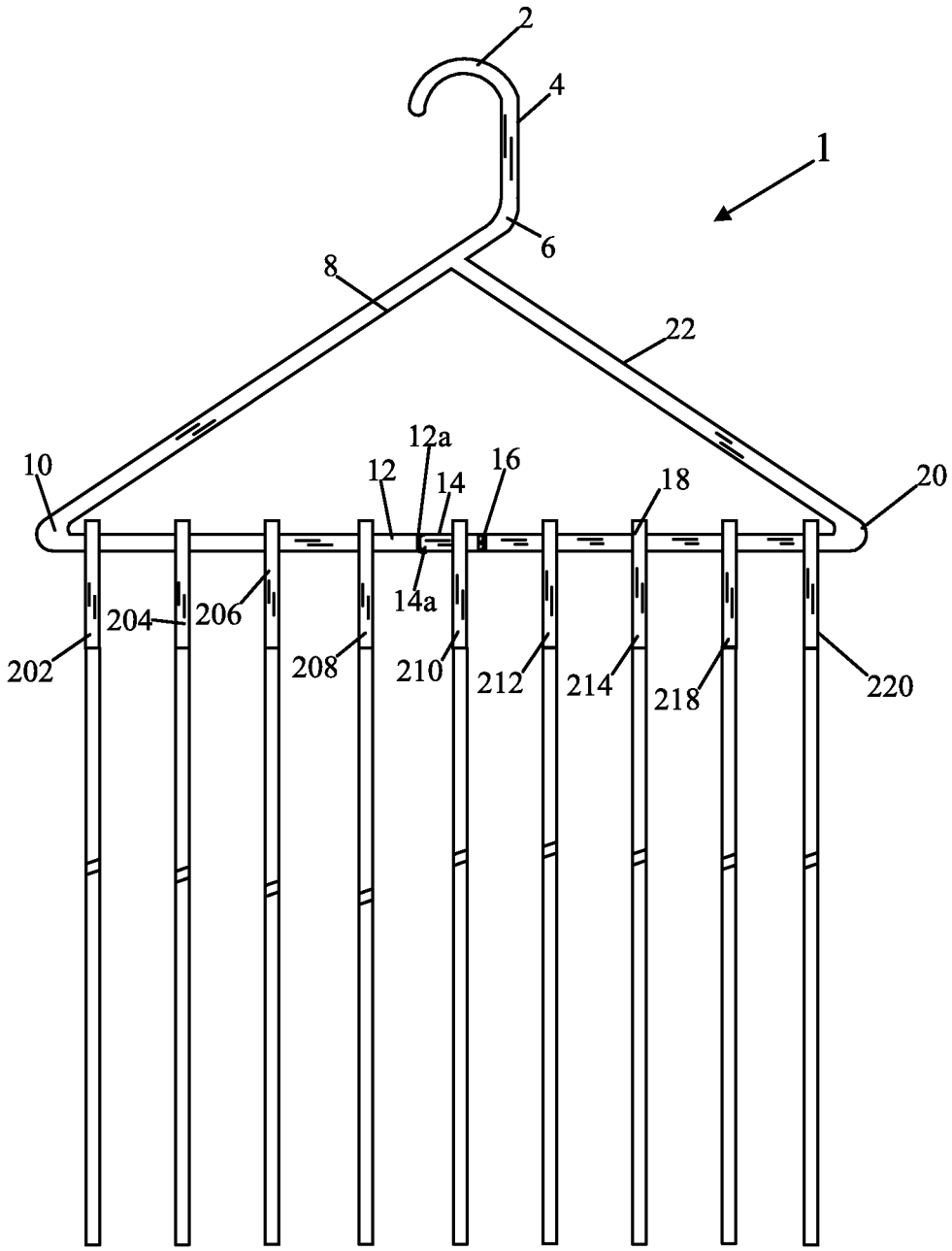
FIG. 6 shows a front view of the first clothes hanger device of FIGS. 1A-B in the first state, with one of the plurality of items removed from the first clothes hanger device and with the rest of the plurality of items hung from the first clothes hanger device.

FIG. 6 shows a front view of the first clothes hanger device 1 of FIG. 1 in the first state, with item 216 removed from the first clothes hanger device 1 and with the rest of the plurality of items 200 hung from the first clothes hanger device 1. The end 14*a* is shown connected to the end 12*a* so that in the state of FIG. 6, there is no gap 15 and the items 202, 204, 206, 208, 210, 212, 214, 218, and 220, in at least one embodiment, cannot be removed from the hanger device 1 (without breaking the particular item or the first clothes hanger device 1), unless the pivot portion 14 is pivoted to cause the gap 15 as in FIG. 5.

In at least one embodiment, the hanger device 1 or the hanger device 100 may hold up a plurality of items 200, such as up to twenty-five items or more depending on the weight of each item of the plurality of items 200. Each item of the plurality of items 200 may be an article of clothing, such as a bra, a belt, or underwear, which has a closed loop. By sliding any selected accessory or item (such as any item of the plurality of items 200) to be removed over the spring loaded lever or pivot portion 14, 114, or 314, the mechanism or pivot portion 14, 114, or 314 allows for a single accessory release without having to remove any of the other accessories from the hanger device 1 or 100. By lightly pulling on the selected accessory or item of the plurality of items 200, the spring loaded lever or pivot portion 14 or 114 releases the accessory or item of items 200 and immediately springs back into place. When the spring loaded lever or pivot portion 14 or 114 is back in place, the bottom of the hanger device 1 or 100 (such as portions 12, 14, and 18 for device 1 and portions 112, 114, and 118 for device 100) acts as a smooth, unbroken, horizontal hanging rod. Once the release mechanism 14 or 114, has sprung back into place the remaining accessories or remaining items of the plurality of items 200 can be redistributed over the length 12, 14, and 18 or 112, 114, and 118) of the hanger device 1 or 100.

The hanger device 1 or 100 can be made of any substance, or substantially or entirely of aluminum such as anodized aluminum, to provide a light weight and sturdy device. The anodized aluminum is also resistant to corrosion and can withstand wear and tear better than other materials. The hook 2 or 102 at the top allows the hanger device 1 or 100 to hang from a typical closet rod.

Figure 7A:
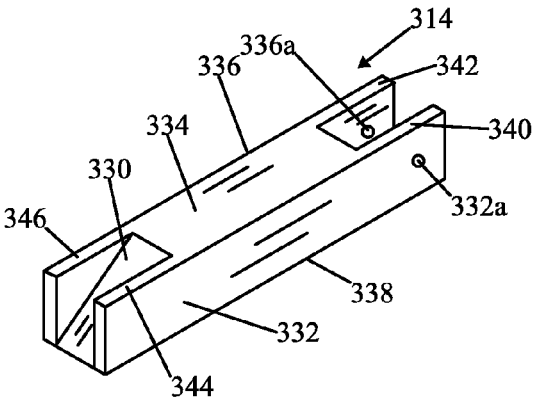
FIG. 7A shows a top, front, right perspective view of first section which can be used with the embodiments of FIGS. 1A and 3A.
Figure 7B:
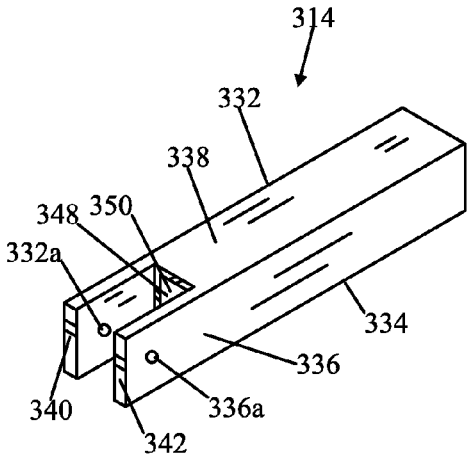
FIG. 7B shows a bottom, rear, left perspective view of the first section of FIG. 7A.
Figure 7C:
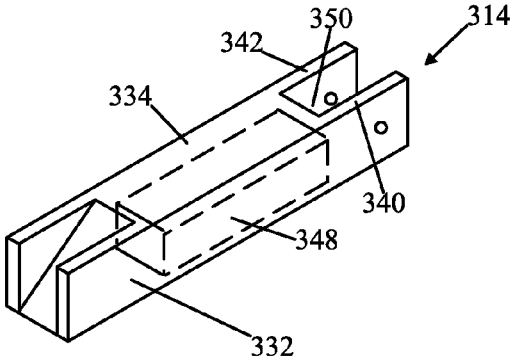
FIG. 7C shows a top, front, right perspective view of the first section of FIG. 7A with a location of an inner chamber shown in dashed lines.
Figure 7D:
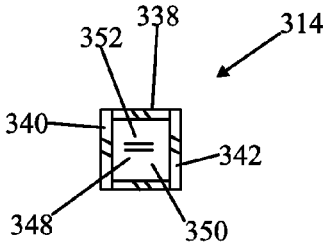
FIG. 7D shows a rear view of the first section of FIG. 7A.

FIG. 7A shows a top, front, right perspective view of first section 314 which can be used with the embodiments of FIGS. 1A and 3A. The first section 314 may be or may replace the section or pivot portion 14 shown in FIG. 1A, or may be or may replace the section or pivot portion 114 shown in FIG. 3A. FIG. 7B shows a bottom, rear, left perspective view of the first section 314. The section 314 includes walls 332, 334, 336, and 338. The section 314 also includes the slanted wall 330, and flanges 340, 342, 344, and 346. The section 314 has openings 332*a* and 336*a* through which a pin, such as pin 16 of FIG. 1A or pin 116 of FIG. 3A can be inserted. The section 314 would be oriented in FIG. 1A (as a replacement for section or pivot portion 14, or as section or pivot portion 14) so that walls 334, 332, and 338 are in the locations corresponding to walls 34, 32, and 38, respectively, shown in FIG. 1A. The section 314 also has an opening 350 which leads to an inner chamber 348 whose location is shown by dashed lines in FIG. 7C. FIG. 7D shows a rear view of the first section 314. The inner chamber 348 terminates at an inner wall 352 which may be the opposite surface of the slanted wall 330 shown in FIG. 7A.

Figure 8A:
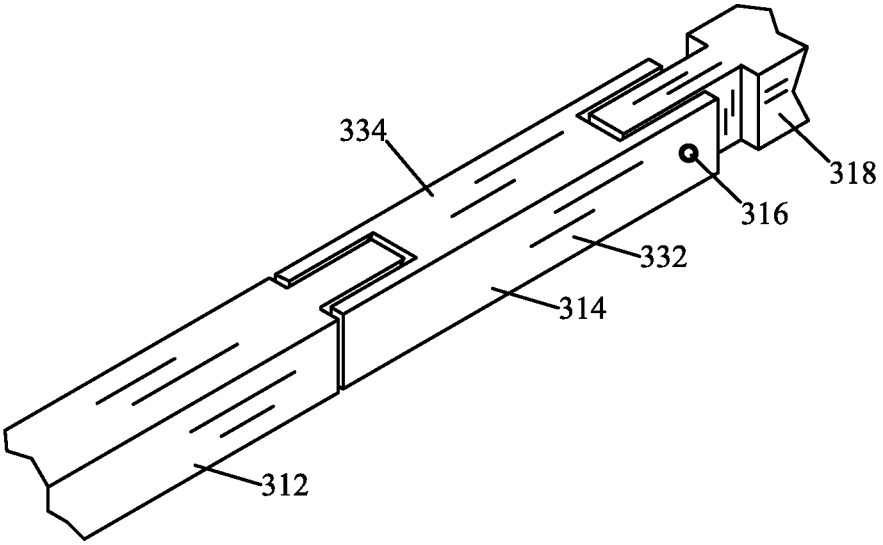
FIG. 8A shows a top, front, right perspective view of the first section of FIG. 7A along with a second, and third section, in a closed state.
Figure 8B:
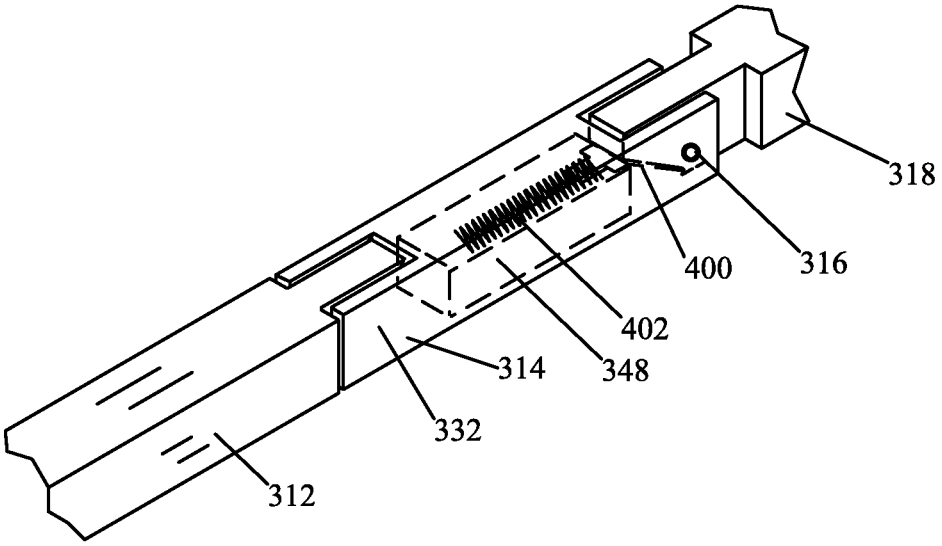
FIG. 8B shows a top, front, right perspective view of the first section of FIG. 7A along with a second, and third section, and with the first section shown in a transparent format so that an inner chamber, shown by dashed lines, a coiled spring, and a spring plate can be seen, and in a closed state.
Figure 9A:
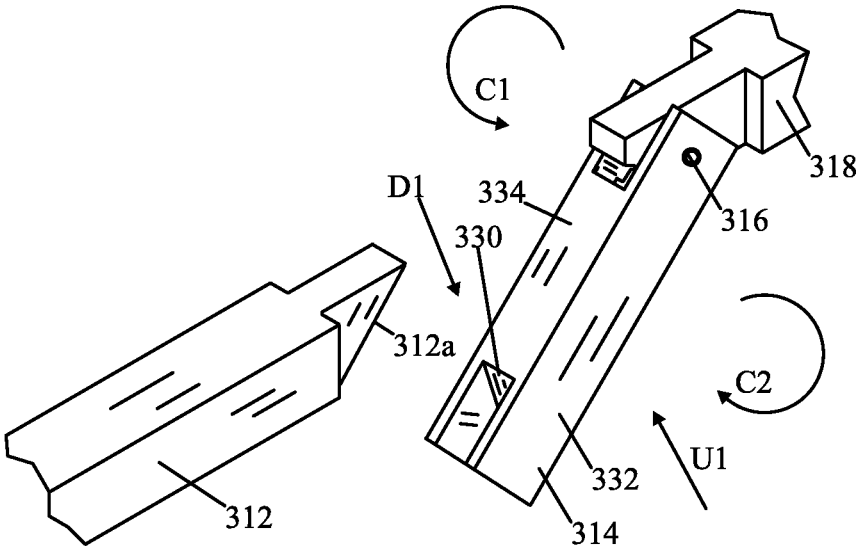
FIG. 9A shows a top, front, right perspective view of the first section of FIG. 7A along with the second, and third section of FIG. 8A, in an opened state.

FIG. 8A shows a top, front, right perspective view of the first section 314 of FIG. 7A along with a second section 312 and third section 318 in a closed state. The second section 312 may be part of or may be a replacement for part of the section or portion 12 shown in FIG. 1A or the section or portion 112 shown in FIG. 3A. The third section 318 may be part of or may be a replacement for part of the section or portion 19 shown in FIG. 1A or the section or portion 118 shown in FIG. 3A. In the closed state of FIG. 8A, the surface or wall 330 of section 314 shown in FIG. 7A, meets with and contacts the surface or wall 312*a* of the section 312 shown in FIG. 9A FIG. 8B shows a top, front, right perspective view of the first section 314 of FIG. 7A along with a second section 312, and the third section 318, and with the first section shown in a transparent format so that the inner chamber 348, shown by dashed lines, a coiled spring 402, and a spring plate 400 can be seen, and in a closed state. FIG. 8B also shows a pin 316 which has been inserted through the openings 332*a* and 336*a* shown in FIG. 7A, in order to connect the section 314 with the section 318 such that section 314 can pivot with respect to section 318 when appropriate force is applied as will be discussed.

Figure 8C:
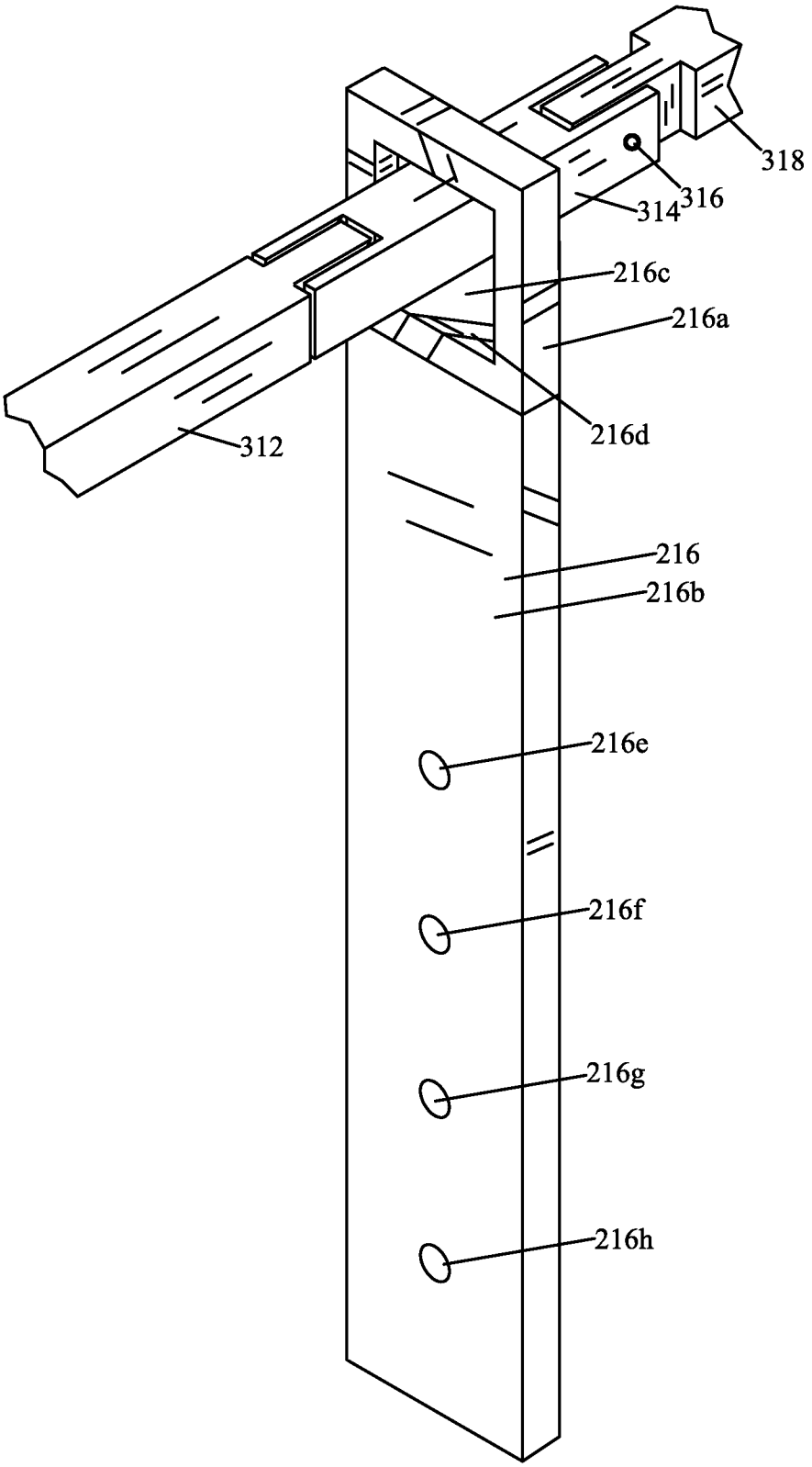
FIG. 8C shows a top, front, right perspective view of the first section of FIG. 7A along with a second, and third section, in a closed state, and along with the item of FIG. 4B.

FIG. 8C shows a top, front, right perspective view of the first section 314 of FIG. 7A along with parts of the second section 312, and third section 318, in a closed state, and along with the item 216 of FIG. 4B. As shown in FIG. 8C, the closed loop 216*a* of the item surrounds the first section 314, and the first section 314 is inserted through the opening 216*c* of the item 216. The protrusion 216*d* has been pivoted to allow the first section 314 to fit through the opening 216*c*.

Figure 9B:
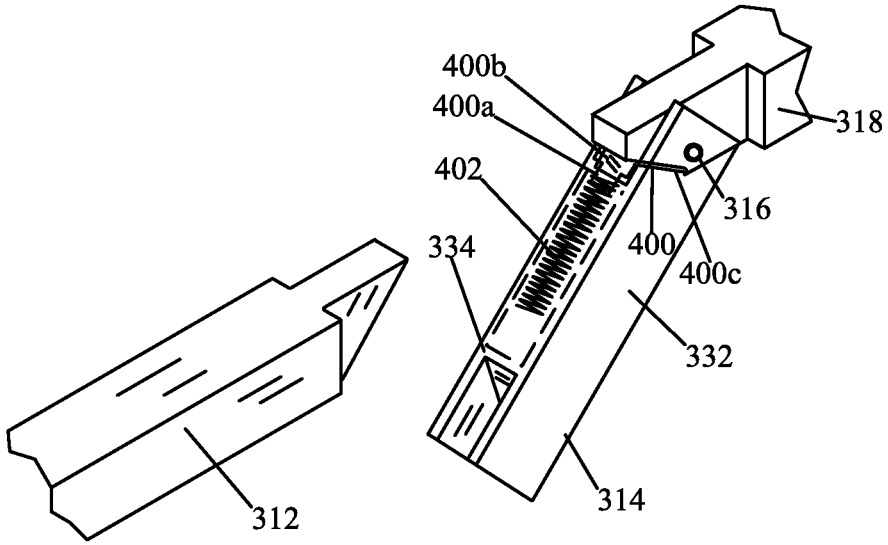
FIG. 9B shows a top, front, right perspective view of the first section of FIG. 7A along with the second, and third section of FIG. 8A, in an opened state, and with the first section shown in a transparent form so that the inner chamber shown by dashed lines, the coiled spring, and the spring plate can be seen.

FIG. 9A shows a top, front, right perspective view of the first section 314 of FIG. 7A along with the second section 312 and the third section 318 in an opened state. FIG. 9B shows a top, front, right perspective view of the first section 314 along with the second section 312, and third section 318, in an opened state, and with the first section 314 shown in a transparent form so that the inner chamber 348 shown by dashed lines can be at least partially seen, and the coiled spring 402, and the spring plate 400 can be seen. The spring plate 400 includes portions 400*a*, 400*b*, and 400*c*.

Figure 10A:
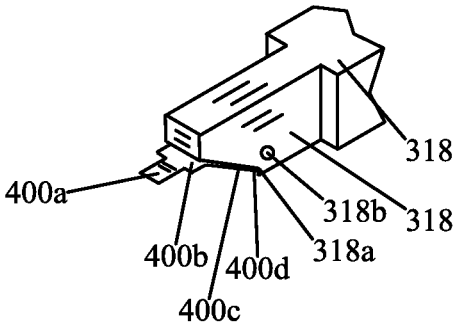
FIG. 10A shows a top, front, right perspective view of the third section of FIG. 8A along with the spring plate shown in FIG. 9B.

Referring to FIG. 9A, a downward force in the direction D1 and/or a counterclockwise force in the direction C1 have been applied to cause the section 314 to change from the closed state of FIGS. 8A-8B to the open state of FIGS. 9A-9B. The section 314 (and the sections 14 and 114) are normally biased in the closed state, and a force must be applied in the direction D1 or C1, for example, to overcome, the bias and to change the section 314 to an open state. The section 314 rotates about the pivot pin 316 and rotates with respect to the section 318 to change from the closed state of FIGS. 8A-8B to the open state of FIGS. 9A-9B. In addition, when the section 314 is pivoted into the open state, the spring plate portions 400*a* and 400*b* bend with respect to the spring plate portion 400*c* which remains stationary. The spring plate portion 400*c* has an end 400*d* which is inserted in an indentation 318*a* of the section 318 as shown by FIG. 10A. Also, when the section 314 is pivoted into the open state of FIG. 9B, the coiled spring 402 may also bend and/or may be compressed. In the open state of FIG. 9A, the spring plate 400 and the coiled spring 402 exert a force in an upward direction U1 and or a clockwise direction C2, in opposition to the forces applies in either the downward direction D1 or counterclockwise direction C1. A person, can use their finger and/or pull downwards on an item such as item 216 in FIG. 5 to cause the downward force in the direction D1 or counterclockwise force in the direction C1 to be applied and to rotate and thereby open section 314. When the person stops applying the force D1 and/or C1, the bias of the coiled spring 402 and the spring plate 400 (forces in directions D2 and/or C2) returns the section 314 to its closed or rest state shown in FIGS. 8A-8B.

Other mechanisms can be used instead of coiled spring 402, and spring plate 400. For example, any mechanism can be used which biases the section 314 into a closed state as in FIG. 8A, and which requires force to put the section 314 in the open state of FIG. 9A, and which returns the section 314 to the closed state of FIG. 8A when the force is removed, can be used, in one or more embodiments of the present invention. The section 314 and a spring mechanism, which may be used, may be a spring gate or sprung gate used to quickly and reversibly connect components in safety critical systems, such as in a carabiner, such as used for rock climbing. A spring gate mechanism as disclosed in FIG. 46 of U.S. Published patent application 2004/0143945, which is incorporated by reference herein, can also be used in accordance with one or more embodiments of the present invention for section 314, spring plate 400 and spring 402, or as an alternative.

Figure 9C:
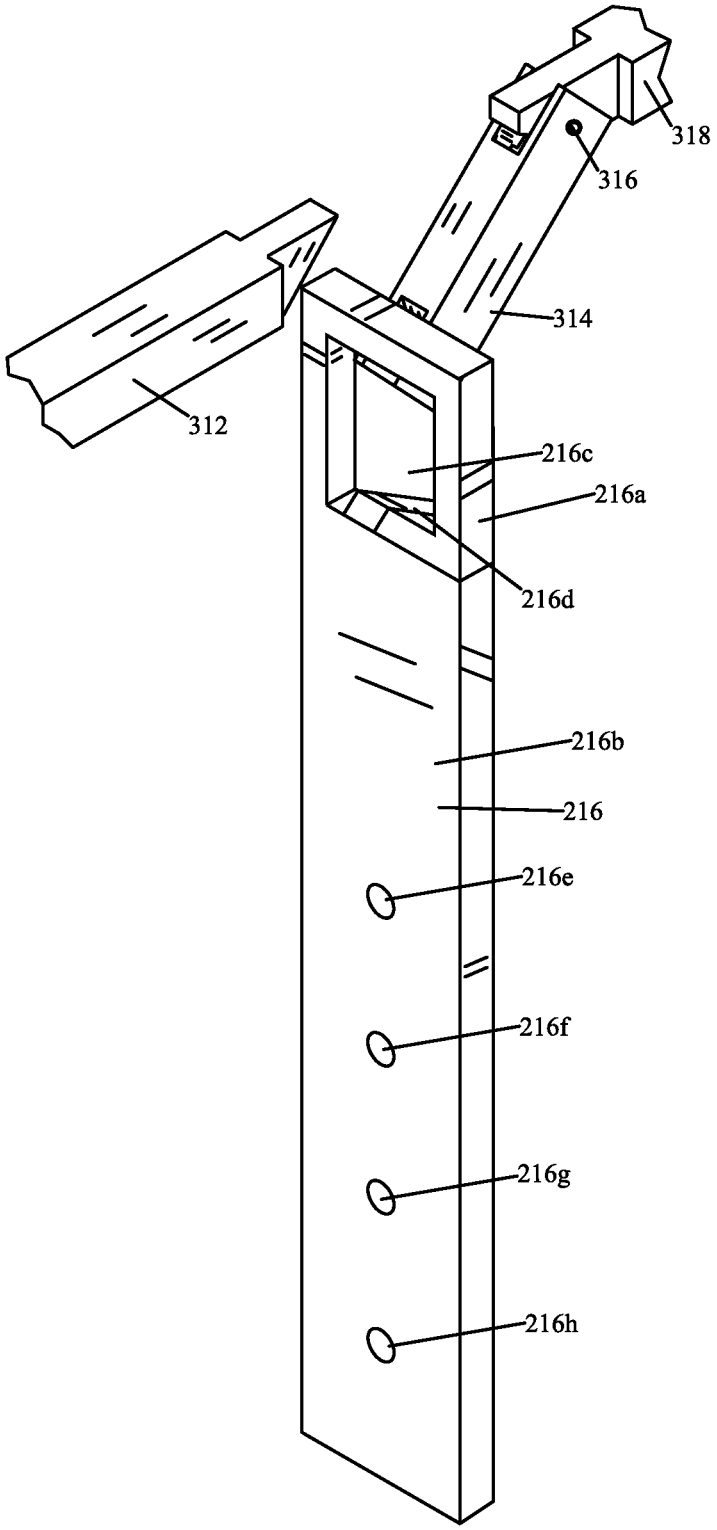
FIG. 9C shows a top, front, right perspective view of the first section of FIG. 7A along with the second, and third section of FIG. 8A, in an opened state, and along with the item of FIG. 4B.

FIG. 9C shows a top, front, right perspective view of the first section 314 of FIG. 7A along with parts of the second section 312, and the third section 318, in an opened state, and along with the item 216 of FIG. 4B. In FIG. 9C, the section 314 has been opened and the item 216 has been slid down the section 314 and can be taken off of the section 314 to remove the item 216 a hanger device, such as hanger device 1, when the sections 314, 312, and 318 are or replace the sections 14, 12, and 18 shown in FIG. 2.

Figure 10B:
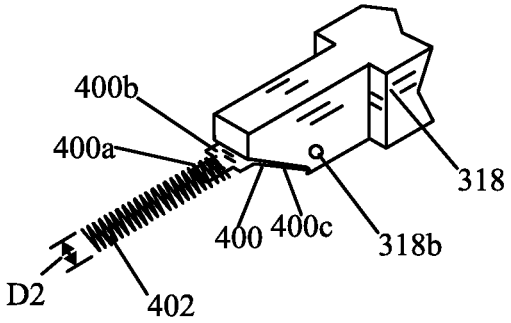
FIG. 10B shows a top, front, right perspective view of the third section of FIG. 8A along with the spring plate shown in FIG. 9B and the coiled spring shown in FIG. 9B.
Figure 10C:
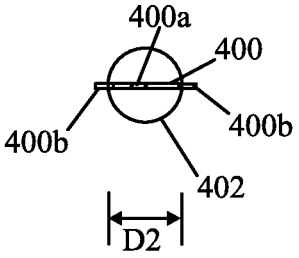
FIG. 10C shows a front view of a part of the spring plate of FIG. 9B inserted into a part of the coiled spring of FIG. 9B.

FIG. 10A shows a top, front, right perspective view of the third section 318 of FIG. 8A along with the spring plate 400 shown in FIG. 9B. FIG. 10B shows a top, front, right perspective view of the third section 318 of FIG. 8A along with the spring plate 400 shown in FIG. 9B and the coiled spring 402. FIG. 100 shows a front view of a part or portion 400*a* of the spring plate 400 inserted into a part of the coiled spring 400 of FIG. 9B. The coiled spring 400 may have circular or substantially circular coils, some of which surround the part 400*a* of the spring plate 400. Each coil of the coiled spring 400 may have an inner diameter D2, shown in FIGS. 10B-C, which is slightly greater than the width of the plate portion 400*a* but less than the width of the plate portion 400*b* so that only the plate portion 400*a* is inserted into the coiled spring 400.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:
a hook portion;
a first device;
a second device, including a first section;
and a third device;
wherein the second device is biased in a closed state so that the first section of the second device, the first device, and the third device are aligned with each other in the closed state;
wherein the hook portion is connected to the first device and the third device;
wherein the first section of the second device, the first device, and the third device are aligned in the closed state such that a closed loop of an item can be slid along the first section of the second device, the first device, and the third device with each of the first section of the second device, the first device, and the third device passing through an opening surrounded by the closed loop;
wherein, while in the closed state, the closed loop cannot be removed from the apparatus without breaking the apparatus;
wherein the second device can be placed in an open state by applying a force, which does not break the apparatus;
wherein in the open state, the closed loop can be removed from the first section;
and further comprising
a spring device;
wherein the second device is biased in the closed state by the spring device which includes a spring;
and wherein the spring includes a plate.

2. An apparatus comprising:
a hook portion;
a first device;
a second device, including a first section;
and a third device;
wherein the second device is biased in a closed state so that the first section of the second device, the first device, and the third device are aligned with each other in the closed state:
wherein the hook portion is connected to the first device and the third device;
wherein the first section of the second device, the first device, and the third device are aligned in the closed state such that a closed loop of an item can be slid along the first section of the second device, the first device, and the third device with each of the first section of the second device, the first device, and the third device passing through an opening surrounded by the closed loop;
wherein, while in the closed state, the closed loop cannot be removed from the apparatus without breaking the apparatus;
wherein the second device can be placed in an open state by applying a force, which does not break the apparatus;
and wherein in the open state, the closed loop can be removed from the first section;
and further comprising
a spring device;
wherein the second device is biased in the closed state by the spring device which includes a spring;
wherein
the spring includes a coiled spring.

3. An apparatus comprising:
a hook portion;
a first device;
a second device, including a first section;
and a third device;
wherein the second device is biased in a closed state so that the first section of the second device, the first device, and the third device are aligned with each other in the closed state:
wherein the hook portion is connected to the first device and the third device;
wherein the first section of the second device, the first device, and the third device are aligned in the closed state such that a closed loop of an item can be slid along the first section of the second device, the first device, and the third device with each of the first section of the second device, the first device, and the third device passing through an opening surrounded by the closed loop;
wherein, while in the closed state, the closed loop cannot be removed from the apparatus without breaking the apparatus;
wherein the second device can be placed in an open state by applying a force, which does not break the apparatus;
wherein in the open state, the closed loop can be removed from the first section;
and further comprising
a pivot pin; and
wherein the first section of the second device is pivotally connected to the third device by the pivot pin.

4. The apparatus of claim 3 wherein
in the closed state, the first device, the first section of the second device, and the third device are in a substantially straight line, and are in an order of the first device, then the first section of the second device, and then the third device.

5. The apparatus of claim 3 wherein
the hook portion has a first free end, and a second end which is connected to a first end of a first member, and a first end of a second member;
wherein a second end of the first member is connected to the first device; and
wherein a second end of the second member is connected to the third device.

6. The apparatus of claim 3 further comprising
a spring device;
and wherein the second device is biased in the closed state by the spring device which includes a spring.

7. The apparatus of claim 6 wherein
the spring includes a plate.

8. The apparatus of claim 7 wherein
the spring includes a coiled spring.

9. A method comprising
applying a force which does not break an apparatus to place the apparatus in an open state;
inserting one or more of a first device, a second device, and a third device of the apparatus through an opening surrounded by a closed loop of an item;
removing the force to place the apparatus in a closed state so that the closed loop of the item cannot be removed from the apparatus without either breaking the apparatus or placing the apparatus in an open state; and
wherein the apparatus includes:
a hook portion,
the first device,
the second device, including a first section,
and the third device;
wherein the second device is biased in a closed state so that the first section of the second device, the first device, and the third device are aligned with each other in the closed state;
wherein the hook portion is connected to the first device and the third device;
wherein the first section of the second device, the first device, and the third device are aligned in the closed state such that the closed loop can be slid along the first section of the second device, the first device, and the third device with each of the first section of the second device, the first device, and the third device passing through the opening surrounded by the closed loop;
wherein the second device is biased in the closed state by a spring device which includes a spring; and
wherein the spring includes a plate.

10. A method comprising
applying a force which does not break an apparatus to place the apparatus in an open state;
inserting one or more of a first device, a second device, and a third device of the apparatus through an opening surrounded by a closed loop of an item;
removing the force to place the apparatus in a closed state so that the closed loop of the item cannot be removed from the apparatus without either breaking the apparatus or placing the apparatus in an open state; and
wherein the apparatus includes:
a hook portion,
the first device,
the second device, including a first section,
and the third device;
wherein the second device is biased in a closed state so that the first section of the second device, the first device, and the third device are aligned with each other in the closed state;
wherein the hook portion is connected to the first device and the third device; and
wherein the first section of the second device, the first device, and the third device are aligned in the closed state such that the closed loop can be slid along the first section of the second device, the first device, and the third device with each of the first section of the second device, the first device, and the third device passing through the opening surrounded by the closed loop;
wherein the second device is biased in the closed state by a spring device which includes a spring; and
wherein
the spring includes a coiled spring.

11. A method comprising
applying a force which does not break an apparatus to place the apparatus in an open state;
inserting one or more of a first device, a second device, and a third device of the apparatus through an opening surrounded by a closed loop of an item;
removing the force to place the apparatus in a closed state so that the closed loop of the item cannot be removed from the apparatus without either breaking the apparatus or placing the apparatus in an open state; and
wherein the apparatus includes:
a hook portion,
the first device,
the second device, including a first section,
and the third device;
wherein the second device is biased in a closed state so that the first section of the second device, the first device, and the third device are aligned with each other in the closed state:
wherein the hook portion is connected to the first device and the third device;
wherein the first section of the second device, the first device, and the third device are aligned in the closed state such that the closed loop can be slid along the first section of the second device, the first device, and the third device with each of the first section of the second device, the first device, and the third device passing through the opening surrounded by the closed loop;
wherein the first section of the second device is pivotally connected to the third device by a pivot pin.

12. The method of claim 11 wherein
in the closed state, the first device, the first section of the second device, and the third device are in a substantially straight line, and are in an order of the first device, then the first section of the second device, and then the third device.

13. The method of claim 11 wherein
the hook portion has a first free end, and a second end which is connected to a first end of a first member, and a first end of a second member;
wherein a second end of the first member is connected to the first device; and
wherein a second end of the second member is connected to the third device.

14. The method of claim 11 wherein
wherein the second device is biased in the closed state by the spring device which includes a spring.

15. The method of claim 14 wherein
the spring includes a plate.

16. The method of claim 15 wherein
the spring includes a coiled spring.

* * * * *